United States Patent [19]

Fischer

[11] 4,450,883

[45] May 29, 1984

[54] HINGE JOINT FOR HOLLOW PANELS FOR COVERING SWIMMING POOLS OR THE LIKE

[76] Inventor: Artur Fischer, Weinhalde 34, D-7244 Tumlingen, Waldachtal 3, Fed. Rep. of Germany

[21] Appl. No.: 340,723

[22] Filed: Jan. 19, 1982

[30] Foreign Application Priority Data

Feb. 5, 1981 [DE] Fed. Rep. of Germany ..... 3103925

[51] Int. Cl.[3] ..... E05D 5/06

[52] U.S. Cl. ..... 160/229 R; 16/365; 16/366; 16/386; 16/387

[58] Field of Search ..... 16/365, 366, 370, 372, 16/386, 387; 49/386; 160/229 R

[56] References Cited

U.S. PATENT DOCUMENTS

| | | | |
|---|---|---|---|
| 2,458,537 | 1/1949 | Skelly | 160/229 R |
| 2,505,848 | 5/1980 | Barlow | 160/229 R |
| 3,359,594 | 12/1967 | Pastoor | 16/356 |
| 3,827,266 | 8/1974 | Walters | 16/386 X |
| 3,941,180 | 3/1976 | Thill | 160/229 R |
| 4,133,142 | 1/1979 | Dzus, Jr. | 49/386 X |
| 4,332,287 | 6/1982 | Stolpe | 160/229 R X |
| 4,388,744 | 6/1983 | Pantke et al. | 16/386 X |

FOREIGN PATENT DOCUMENTS

| | | | |
|---|---|---|---|
| 2025403 | 12/1971 | Fed. Rep. of Germany | 16/386 |

*Primary Examiner*—Fred Silverberg
*Attorney, Agent, or Firm*—Michael J. Striker

[57] ABSTRACT

A hinge joint for joining hollow panels utilized for covering swimming pools includes two leaf-like connecting parts with overlapped portions each having an axial bore to receive a hinge pin. Each connecting part has a supporting bar hooked into a bore provided in the outside face of the cover panel and extended into the cavity formed in the hollow panel.

9 Claims, 3 Drawing Figures

HINGE JOINT FOR HOLLOW PANELS FOR COVERING SWIMMING POOLS OR THE LIKE

BACKGROUND OF THE INVENTION

The present invention relates to a hinge joint in general, and more particularly to a hinge joint for joining together hollow panels utilized for covering swimming pools.

The panels normally used for covering swimming pools include top and bottom cover panels connected to each other by longitudinal parallel ribs which form cavities closed on all sides.

The known hollow panels are usually made out of plastic materials having a high degree of insulation against heat loss, such as polycarbonate, polypropylene or the like. Such panels are therefore suitable for covering the body of water in heated swimming pools. In order to uncover the pool it has been found advantageous for the individual panels to be folded together in a concertina-like fashion towards one side of the pool. In order to obtain an adequate insulation against heat loss, the hollow panels are sealed in a water-tight manner at their front faces. When hinge joints are fitted on the panels there should be no leaky areas through which water can penetrate into the cavities of the hollow panels.

SUMMARY OF THE INVENTION

It is an object of the invenion to provide an improved hinge joint for hollow panels utilized for covering swimming pools.

It is a further object of the invention to provide a hinge joint for hollow panels in which all the above-described requirements are fulfilled.

These and other objects of the invention are attained by a hinge joint for joining hollow panels for use particularly for covering swimming pools, each panel including a top cover panel and a botttom cover panel and a plurality of longitudinal ribs extending between the bottom and the top cover panels to form a plurality of closed cavities, the respective cover panels of the hollow panels to be joined being formed each with at least one bore, the hinge joint comprising two connecting parts receiving a hinge pin to join them together, each connecting part including at least one supporting bar inserted through said bore into a respective cavity and a flange covering and sealing off the bore.

Because of the supporting bars arranged on the connecting parts, hook-like members are formed which can be hooked through the bores of the cover-panel into the cavities of the hollow panels. The forces acting on the hinge joints are accommodated by the large bearing area of the supporting bars on the inner side of the cover-panel. The flange provided on the connecting part and covering the bore seals the bore in the cover-panel so that no water is able to penetrate the cavities.

Each connecting part may be formed as a leaf extending transversely of the supporting bar in assembly and including a cut-away portion extending beyond said flange, the cut-away portions of two connecting parts overlapping one another.

The cut-away portions may form a knuckle having an axial bore receiving the hinge pin.

This design produces a very simple hinge joint in which both the connecting parts are identical and the bores for hooking them in are in alignment.

The supporting bars of two hollow panels to be joined together may be inserted into the associated cavities in opposite directions.

A sealing may be provided between the flange of the connecting part and an outside surface of the respective cover-panel. The sealing may be a sealing ring or a sealing compound. As a result of the bracing between the flange and the bearing area of the supporting bar, the sealing ring or sealing compound is firmly pressed against the surface of the cover-panel and thus seals the bore hole in a water-tight manner.

The hinge pin may include a pin head and a stub opposite to said head, said stub being hooked into the associated leaf to lock said hinge pin in assembly.

One bore in the cover panels may be formed in the top cover panel of one hollow panel and another bore may be formed in the bottom cover panel of the adjacent hollow panel so that the adjacent hollow panels which are joined together by the hinge joint may be folded together in a concertina-like fashion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
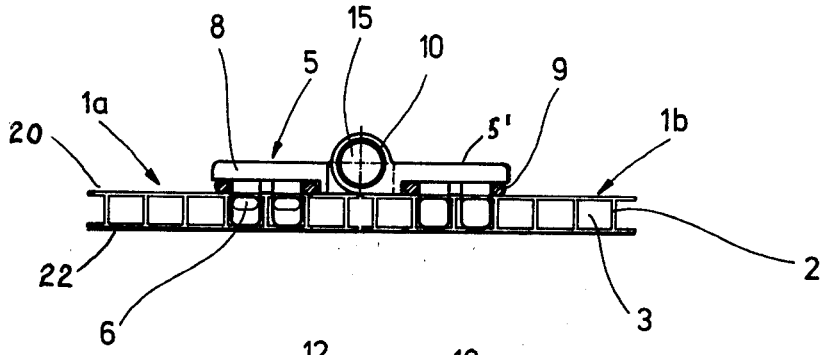
FIG. 1 is a side view of a hinge joint of two hollow panels according to the invention.
Figure 2:
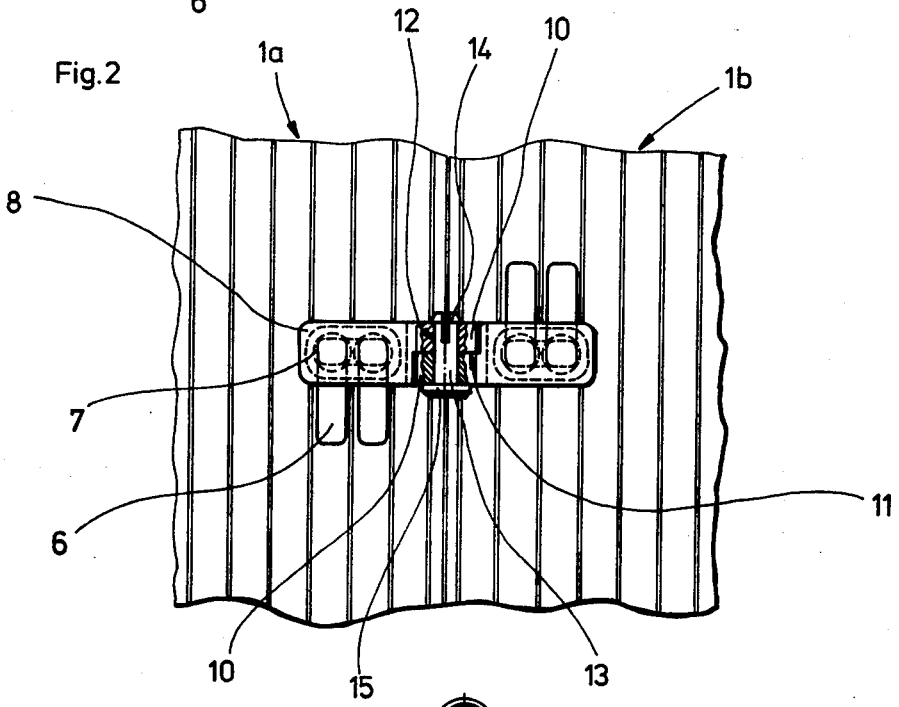
FIG. 2 is a plan view of FIG. 1.

With reference to FIGS. 1 and 2, it may be seen that two panels 1*a* and 1*b* are shown in a position connected by a hinge joint according to the invention. Each panel is made out of synthetic plastic material, such as polycarbonate, polypropylene or the like. Each panel is formed by two parallel elongated cover-panels 20 and 22 forming upper and lower surfaces of the panel and a plurality of longitudinally extending ribs 2 which run parallel to each other between the upper and lower surfaces of the panel to form a plurality of cavities 3.

Hollow panels 1*a* and 1*b* are placed next to one another at their longitudinal sides so that the cavities 3 of both panels run in parallel.

A number of bores 7 are made in the cover-panels 20, 22.

A hinge-joint generally designated as 5 includes two connecting parts 5' formed with openings 12 to receive a hinge pin 13. Each connecting part 5' is provided with a number of supporting bars 6 which are inserted into respective bores 7 and extended in the respective cavities 3. Two angularly-shaped supporting bars 6 are shown in this embodiment on each connecting part 5'. Bores 7 in the cover-panels 20, 22 are somewhat larger than the width across corners of the supporting bars 6. Thus, after the supporting bars of connecting parts 5' have been hooked in the bores 7 a gap is formed into which water might penetrate if the hollow panels 1*a*, 1*b* were used for covering a swimming pool. In order to prevent this each connecting part 5' is formed with a flange 8 which rests on the outside surface of the cover-panel when the connecting part has been hooked in. In order to improve a seal a sealing ring 9 is inserted between the flange 8 and the outside surface of the cover-panel. Alternatively, a sealing compound may be placed between flange 8 and the outside surface of the cover-panel.

The connecting parts 5' are each designed with a leaf 10 extending transversely to the supporting bar 6. Respective leaves 10 of the two adjacent connecting parts overlap one another and form a cut-away knuckle 11. The knuckle 11 forms the openings 12 receiving the hinge pin 13. Due to the provision of cut-away knuckle 11 the two leaves 10 overlap whilst the bores 7 into which supporting bars 6 are hooked are in alignment.

After two adjacent hollow panels 1*a* and 1*b* have been aligned the axial openings 12 in two leaves 10 come into register so that the joint can be produced using the hinge pin 13.

The hinge pin 13 has locking stubs 14 which hook into the rear side of the leaf 10 after the pin 13 is pushed in as far as its head 15 abuts against the front surface of the opposite leaf 10. In order to make two identical connecting parts 5' to fit together it is necessary to insert supporting bars 6 of the adjacent panels so that they will lie in opposite directions as shown in FIG. 2.

To join two panels to each other, at least two hinge joints are arranged along each panel close to the end faces.

Figure 3:
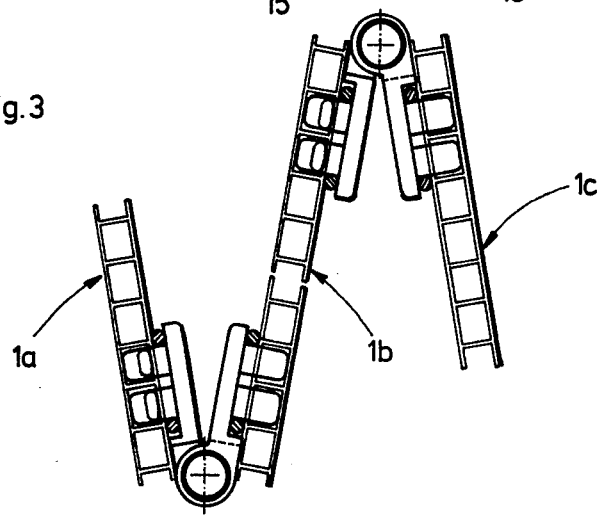
FIG. 3 is a side view of several hinge-joined hollow panels folded together.

FIG. 3 illustrates three hollow panels folded together to produce a covering which can be folded together in a concertina-like fashion; several hollow panels 1*a*, 1*b*, 1*c* are joined together in the manner described hereinabove, the hinge joints being placed alternately on the top and the bottom of the respective adjacent cover-panels.

It will be understood that each of the elements described above, or two or more together, may also find a useful application in other types of hinge joints differing from the types described above.

While the invention has been illustrated and described as embodied in a hinge joint for connecting hollow panels to each other, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hinge joint for joining hollow panels for use particularly for covering swimming pools, each hollow panel including a top cover wall and a bottom cover wall parallel to the top wall, and a plurality of longitudinal parallel ribs extending between the bottom and the top cover walls to form therebetween a plurality of closed cavities, each said cover wall having an outer side and an inner side facing said cavities, respective said cover walls of the hollow panels to be joined being each formed with at least one bore, the hinge joint comprising two connecting parts receiving a hinge pin to join them together, each connecting part including at least one supporting bar inserted through said bore into a respective one of said cavities and hooked therein, and a flange intergral with said supporting bar and resting against the outer side of the respective cover wall so as to completely cover said bore and seal it off, wherein said supporting bar is angularly shaped and has an elongated portion which extends normal to said flange when the supporting bar is hooked into said one of said cavities.

2. The joint of claim 1, wherein each said connecting part is formed as a leaf extending transversely of said supporting bar in assembly and including a cut-away portion extending beyond said flange, the cut-away portions of two connecting parts overlapping one another.

3. The joint of claim 2, wherein said cut-away portions form a knuckle having an axial bore receiving said hinge pin.

4. The joint of claim 3, wherein a sealing is provided between said flange and an outside surface of a respective said cover wall.

5. The joint of claim 4, wherein said sealing is a sealing ring.

6. The joint of claim 4, wherein said sealing is a sealing compound.

7. The joint of claim 4, wherein said hinge pin includes a pin head and a stub opposite to said head, said stub being hooked into the associated leaf to lock said hinge pin in assembly.

8. The joint of claim 7, wherein one said bore is formed in the top cover wall of one hollow panel and another said bore is formed in the bottom cover wall of the adjacent hollow panel so that the adjacent hollow panels which are joined together by the hinge joint may be folded together in a concertina-like fashion.

9. The joint of claim 1, wherein the supporting bars of the hinge joint of the hollow panels to be joined are inserted into the associated cavities such that the elongated portions of said bars extend in said cavities in opposite directions.

* * * * *